US006234135B1

(12) United States Patent
Lindblom

(10) Patent No.: US 6,234,135 B1
(45) Date of Patent: May 22, 2001

(54) ELONGATED CYLINDER HEAD FOR MOUNTING ON FOR INSTANCE A DIESEL ENGINE HAVING CAVITIES FOR INJECTION UNITS AND SUPPLY MEANS FOR LIQUID FUEL

(75) Inventor: Jan Lindblom, Lycke (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/269,955

(22) PCT Filed: Sep. 24, 1997

(86) PCT No.: PCT/SE97/01602

§ 371 Date: Jun. 4, 1999

§ 102(e) Date: Jun. 4, 1999

(87) PCT Pub. No.: WO98/16730

PCT Pub. Date: Apr. 23, 1998

(30) Foreign Application Priority Data

Oct. 11, 1996 (SE) ..... 9603712

(51) Int. Cl.[7] ..... F02F 1/24; F02M 55/00

(52) U.S. Cl. ..... 123/193.5; 123/456

(58) Field of Search ..... 123/193.5, 193.2, 123/193.3, 193.1, 467, 468, 456

(56) References Cited

U.S. PATENT DOCUMENTS

| | | | | |
|---|---|---|---|---|
| 5,297,524 | * | 3/1994 | Fransson et al. | 123/193.5 |
| 5,411,001 | * | 5/1995 | Werner et al. | 123/456 |
| 5,692,477 | * | 12/1997 | Berger et al. | 123/468 |
| 5,752,486 | * | 5/1998 | Nakashima et al. | 123/467 |

FOREIGN PATENT DOCUMENTS

| | | |
|---|---|---|
| 826 216 | 12/1951 | (DE) . |
| 42 41 374 A1 | 6/1994 | (DE) . |
| 468 719 | 3/1993 | (SE) . |

* cited by examiner

*Primary Examiner*—Marguerite McMahon
(74) *Attorney, Agent, or Firm*—Lerner, David, Littenberg, Krumholz & Mentlik, LLP

(57) ABSTRACT

The present invention relates to a longitudinal cylinder head (1) for mounting on, for example, a diesel engine having cavities (18) for injection units (2) and supply means for liquid fuel. The invention is characterized by only one longitudinal fuel passage (17) for supply of fuel to all injection units (2).

13 Claims, 3 Drawing Sheets

ELONGATED CYLINDER HEAD FOR MOUNTING ON FOR INSTANCE A DIESEL ENGINE HAVING CAVITIES FOR INJECTION UNITS AND SUPPLY MEANS FOR LIQUID FUEL

TECHNICAL FIELD

The present invention relates to a cylinder head for mounting on, for example, a diesel engine, which cylinder head is provided with cavities for injection units for fuel into the engine and supply means for liquid fuel. Such cylinder heads have an elongated shape and are intended to be mounted on preferably the top side of an engine having several cylinders, e.g. six.

PRIOR ART

Engines which are driven by liquid fuel, e.g. diesel oil, usually include a plurality of cylinders which at a regulated rate shall be provided with fuel by an injection nozzle and sufficient air for the combustion and must have an outlet for the exhaust gases. These functions are usually collected in a cylinder head which is mounted as a cover on the cylinders. Since the cylinders stand in a row, the cylinder head will be elongated.

The cylinder head is mostly moulded with completed passages for air and exhaust gases and possibly cavities for the fuel injection units. These cavities may also be bored. However, something that is always necessary is to bore passages for supply of fuel to the cavities for the fuel injection units. These passages, of which there are two, normally have a diameter of approximately 9,5 millimetres and they must run at a certain, short distance from each other through the whole length of the cylinder head. The passages are bored usually from the ends of both short sides. Since fuel from these passages is to be forced into the fuel injection units, it is necessary to seal the passages both from each other and from the surroundings. Three surfaces which seal against O-rings have therefore been mounted on the injection unit, one below the lowermost passage, the second between the passages and the third above the uppermost passage.

One of the passages, preferably the lower one, is intended to feed fuel to the fuel injection units, whereas the second passage is intended for surplus fuel and to lead this in the opposite direction to that which the fuel has in the first passage and to maintain a certain pressure in the system. The pressure level is controlled by a valve mounted in connection to the second passage.

The amount of fuel which is to be injected into the engine is portioned out through the injection units. However, the total amount of these portions is much lower than the circulating amount, which is about four to eight times the total injected amount.

TECHNICAL PROBLEM

The space in the cylinder head is limited since it shall include both the inlet and the exhaust gas passages for the engine and also cooling passages. Two fuel passages will therefore result in the dimension of these and further passages having to be limited. The limited space does not allow for desired freedom for designing these.

As a result of the small dimension of the bores working difficulties will arise, since it is difficult to maintain a straight and accurate direction in a bore having a small diameter and a great length, usually in the order of 1 m. As a consequence of this, a high incidence of rejects of the cylinder heads will arise and a high level of process conducting will be required, which together will result in high production costs.

With two passages, four outlets in every injection cavity will also be obtained, which outlets (or inlets) must be deburred so that impurities in the form of burrs will not come out into the fuel and cause damage to the impurity-sensitive injection units. This deburring requires great attention, care and accuracy and has a negative influence on the production costs.

Various fuels which can be used in the engine are temperature-sensitive and the lubricating capability etc. is negatively influenced by a too high temperature, and leading to operational disturbances. The cooling liquid and the greasing oil in and around the cylinder head heat the fuel which is transported through the borings in the cylinder head and it is therefore of great importance that the heat transfer between the colder fuel and the surroundings will be as small as possible. With two passages each having a diameter of normally 9,5 mm and a length of 1 m a projected heat transfer surface of about 60 000 $mm^2$ will be obtained.

THE SOLUTION

According to the present invention, the above problems have been solved by means of an elongated cylinder head for mounting on, for example, a diesel engine having cavities for injection units and means for supplying liquid fuel, such as diesel oil, to these units, as well as the usual air and cooling passages, if required. The cylinder head is characterized by having only one longitudinal fuel passage for feeding of fuel to and removing of fuel from all injection units.

According to the invention, it is suitable that the fuel passage ends in one or both of the shorter sides of the elongated cylinder head.

According to the invention, one or more transverse passages for feeding or removing of fuel to or from the longitudinal passage may however be arranged at one or both of the ends of the longitudinal fuel passage.

According to the invention, a valve for controlling the pressure of the fuel in the longitudinal fuel passage may be arranged therein at the outlet end for the fuel or outside the passage.

Further, it is suitable, according to the invention, that the longitudinal fuel passage has a diameter of 10–15 mm.

According to the invention, only two surfaces for sealing against O-rings mounted on the injection units may be made in each cavity for the injection units, one above and one below the inlet and outlet openings for the longitudinal fuel passage.

FIGURE DESCRIPTION

The invention will in the following be described more in detail in connection with the attached figures where FIG. 1 schematically shows a flow sheet for fuel with a cylinder head according to the prior art, where FIG. 2 in an enlarged scale shows a part of the flow sheet according to FIG. 1, but with a cylinder head according to the present invention, and where FIG. 3 shows a view from above of a cylinder head according to the present invention and a longitudinal section and a cross-section of the cylinder head along the lines B—B and A—A.

DETAILED DESCRIPTION OF A PREFERRED EMBODIMENT

FIG. 1 shows schematically and in section a cylinder head 1. Six cavities are arranged in the cylinder head in this present case, which cavities each house an injection unit 2. These injection units 2 are supplied with fuel through two passages 3 and 4. The passage 3 is the main supply passage whereas the passage 4 is intended for overflow fuel. By means of a cam shaft that is not shown, a piston is pressed by a pin 5 against a spring force down into the injection unit 2 and causes the injection. The amount of injected fuel and the time for this injection is controlled by means of valve arrangement 6 shown schematically. When the piston is going upwards in the injection unit 2 fuel is sucked into this unit via a hole in the cylinder wall or a suitable valve arrangement.

It is important that the fuel flows in the cylinder head 1 are kept separated in a regulated way and therefore three O-rings 7 in grooves on the units 2 have been arranged. These O-rings 7 are located above the passage 4, below the passage 3 and between the two passages.

The pressure in the fuel system is made by means of a pump 8 which, via a filter 9 and a conduit 10, presses the fuel into the cylinder head 1. The pressure in the conduit 10 may be in the region of 3–4 bar and it is regulated by a valve 11. The fuel which flows out against the pressure in the pressure controlling valve 11 arrives via the conduit 12 back into the pump 8. From the pump 8 a conduit 13 also leads to the fuel tank 14 wherefrom fuel is sucked up through the conduit 15 and via a cooling arrangement 16 is united with the outgoing flow from the cylinder head 1 at the pressure valve 11.

The amount of fuel which is pumped through the conduit 12 is much larger than the amount of fuel used and in the order of 2–12 lit/min. The amount of fuel which is sucked up from the fuel tank 14 through the conduit 15 will be in the order of 0,2–1,5 l./min. The conduit 13 and the throttle 21 are an arrangement for removing possible gas in the system.

The longitudinal passages 3, 4, which may have a length of in the order of 1 m, are drilled from each end usually by means of a gun boring drill. It is of the utmost importance that the two passages 3, 4 end in the cavities for the fuel injection units 2 at a correct location. This is of course difficult to bring about since the passages are long as well as narrow, usually 1 m and 9,5 mm. To ensure that the outlets into the cavities for the fuel injection units 2 shall be clean from splinters they must be deburred. There are two passages 3 and 4 and three O-rings 7, which causes the deburring and fine treatment work to be rather costly.

According to the prior art which is shown in FIG. 1, the fuel supply is arranged at the rear of the cylinder head. If the engine is installed in a vehicle and, as is usual, is not horizontal but sloping slightly backwards, this will make it difficult for any gas in the system to be transported out since, according to the laws of nature, it will try to rise to the highest point in the engine. This results in some cases in difficulties in bleeding gas from the system in connection with repairs, etc. when the system is emptied of fuel. In FIG. 1 the rear side of the cylinder head 1 is to the right in the figure.

In FIG. 2 a fuel supply arrangement having a cylinder head 1 according to the present invention is shown in an enlarged scale. The reference numerals in this figure refer to the same elements as those in FIG. 1. The difference between the cylinder head in this figure and the one according to the prior art according to FIG. 1 is that here only one fuel supply passage 17 exists in the cylinder 1. Thereby, the construction of the cylinder head is simplified. Only one through flowing direction for fuel is obtained and only two O-rings 7, one on each side of the fuel passage 17, are needed.

The supply of fuel to the cylinder head 1 occurs in this case at the rear side of the cylinder head 1 through the conduit 10 and access fuel is taken out at the front side where the pressure fuel 11 is arranged. Since only one passage 17 is necessary according to the present invention, this passage may be made with a larger diameter than when two passages 3 and 4 are drilled. The passage 17 usually has a diameter of 12,5 mm but it may vary between 10 and 15 mm. The reason for this is that only one passage is present, which of course requires less space than when two passages must be made. When two passages 3, 4 are made according to the prior art, these must have a certain distance from each other so that a sufficient material thickness may be obtained. This results in the fact that other passages such as air passages for the combustion air and exhaust passages which also must have a certain wall thickness compared to the surroundings must be made in such a way that they do not give optimal flow of the air and the exhaust gases. In the arrangement according to the present invention, with only one passage 17 more space for this combustion air and exhaust gas passage and also cooling passages which usually are made in the cylinder head 1 is obtained.

The pressure control valve may be mounted directly in the cylinder head 1. It is of course possible to arrange it at another place also in connection with a suitable pipe or hose. Since the pressure valve and the fuel can be taken out at the forward side of the cylinder head 1 which usually slopes somewhat backwards, the problem with air in the fuel passage is also solved since this air can simply be allowed to escape at the forward side, which is the highest point in the system.

FIG. 3 shows only the cylinder head 1 seen both from above and through the sections B—B and A—A. Six cavities 18 are drilled or shaped in some other way in the cylinder head 1 and these cavities end in an opening 19 through which the fuel injector protrudes into the engine cavity. At both ends of the cylinder head 1 transverse fuel passages 20 are arranged. These transverse passages 20 have been made to allow the supply of fuel to be arranged in different ways. One or two of the passages 20 may be used and the others may be plugged or all may be plugged and the fuel supplied directly into the passage 17.

Through the present invention several different advantages compared to the cylinder heads which are manufactured according to the prior art having two narrow passages are accordingly obtained. It is easy to drill the passage in the longitudinal direction of the cylinder head but other manufacturing methods such as moulding or alternative working methods may also be used. The cylinder head according to the invention has also been made more compatible with other systems since the fuel supply may be arranged from the side or from above.

By correctly arranging a fuel passage having a size of 10–15 mm in the cylinder head a construction of the inlet and exhaust passages in the motor having minimized flow disturbances is made possible. This can be used to improve efficiency of the motor.

The incidence of rejects due to the fact that the direction of the drilling of the passages 3 and 4 cannot be correctly maintained is eliminated. The time for making one passage instead of two is shorter and a lower total manufacturing cost can be obtained. The number of deburring points in each injection cavity is halved, which results in a shorter manufacturing time and consequently lowered manufacturing cost. Only one fuel passage and a motor so arranged that the fuel outlet may occur in the forward part of the cylinder head makes it possible to correctly transport possible gases. Handling in connection with, for example, repairs is substantially improved. The engine can in this case without problems have a somewhat backwards sloping position. One passage having, for example, a diameter of 12,5 mm and a length of 1 m gives a smaller projected surface, namely about 39 000 $mm^2$ compared with two passages of 9.5 mm, which gives a projected surface of about 60 000 $mm^2$. A decreased surface gives a lower heat transfer and thus less influence on the properties of the fuel. The risk of operational disturbances and damage to the components of the fuel system is therefore lowered.

The invention is not limited to the embodiment example but can be varied in different ways within the scope of the claims.

What is claimed is:

1. An elongated cylinder head for mounting on an engine, said elongated cylinder head including a first end and a second end, said first and second ends being transverse to the longitudinal direction of said elongated cylinder head, and said elongated cylinder head including a plurality of cavities for a corresponding plurality of injection units, and consisting of a single longitudinally extending fuel passage interconnecting said plurality of cavities whereby all of the fuel for each of said plurality of injection units is fed to and removed from said plurality of injection units thereby.

2. The elongated cylinder head of claim 1 wherein said engine comprises a diesel engine, and said fuel comprises a diesel oil.

3. The elongated cylinder head of claim 1 including an air passage for feeding air to said elongated cylinder head.

4. The elongated cylinder head of claim 3 including a coolant passage for feeding coolant to said elongated cylinder head.

5. The elongated cylinder head of claim 1 wherein said longitudinally extending fuel passage exits into at least one of said first and second ends.

6. The elongated cylinder head of claim 5 wherein said longitudinally extending fuel passage exits into both said first and second ends.

7. The elongated cylinder head of claim 1 wherein said elongated cylinder head includes at least one transverse passage connected to said longitudinally extending fuel passage for supplying or removing fuel therefrom.

8. The elongated cylinder head of claim 7 wherein said at least one transverse passage is located proximate to one of said first and second ends of said elongated cylinder head.

9. The elongated cylinder head of claim 7 wherein one of said transverse passages is located proximate to each of said first and second ends of said elongated cylinder head.

10. The elongated cylinder head of claim 1 including a pressure valve controlling the pressure of said fuel in said longitudinally extending fuel passage.

11. The elongated cylinder head of claim 10 wherein said pressure valve is disposed in association with said one of said first and second ends which comprises the outlet for said longitudinally extending fuel path.

12. The elongated cylinder head of claim 1 wherein said longitudinally extending fuel passage has a diameter of between about 10 and 15 mm.

13. The elongated cylinder head of claim 1 wherein said longitudinally extending fuel passage includes an inlet and an outlet associated with each of said plurality of cavities, and wherein said elongated cylinder head includes only two surfaces adapted for sealing with an O-ring, said two surfaces including a first surface disposed above said inlet and said outlet for each of said plurality of cavities and a second surface disposed below said inlet and said outlet for each of said plurality of cavities.

* * * * *

UNITED STATES PATENT AND TRADEMARK OFFICE

CERTIFICATE OF CORRECTION

PATENT NO. : 6,234,135 B1
DATED : May 22, 2001
INVENTOR(S) : Lindblom

It is certified that error appears in the above-identified patent and that said Letters Patent is hereby corrected as shown below:

Substitute the attached sheets consisting of the Title page showing the ABSTRACT and specification consisting of columns 1-6.

Signed and Sealed this

Twenty-third Day of November, 2004

JON W. DUDAS
*Director of the United States Patent and Trademark Office*

(12) United States Patent
Lindblom

(10) Patent No.: US 6,234,135 B1
(45) Date of Patent: May 22, 2001

(54) ELONGATED CYLINDER HEAD FOR MOUNTING ON FOR INSTANCE A DIESEL ENGINE HAVING CAVITIES FOR INJECTION UNITS AND SUPPLY MEANS FOR LIQUID FUEL

(75) Inventor: Jan Lindblom, Lycke (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/269,955

(22) PCT Filed: Sep. 24, 1997

(86) PCT No.: PCT/SE97/01602

§ 371 Date: Jun. 4, 1999

§ 102(e) Date: Jun. 4, 1999

(87) PCT Pub. No.: WO98/16730

PCT Pub. Date: Apr. 23, 1998

(30) Foreign Application Priority Data

Oct. 11, 1996 (SE) ..... 9603712

(51) Int. Cl.[7] ..... F02F 1/24; F02M 55/00
(52) U.S. Cl. ..... 123/193.5; 123/456
(58) Field of Search ..... 123/193.5, 193.2, 123/193.3, 193.1, 467, 468, 456

(56) References Cited

U.S. PATENT DOCUMENTS 5,297,524 * 3/1994 Fransson et al. ..... 123/193.5
5,411,001 * 5/1995 Werner et al. ..... 123/456
5,692,477 * 12/1997 Berger et al. ..... 123/468
5,752,486 * 5/1998 Nakashima et al. ..... 123/467

FOREIGN PATENT DOCUMENTS 826 216 12/1951 (DE) .
42 41 374 A1 6/1994 (DE) .
468 719 3/1993 (SE) .

* cited by examiner

*Primary Examiner*—Marguerite McMahon
(74) *Attorney, Agent, or Firm*—Lerner, David, Littenberg, Krumholz & Mentlik, LLP

(57) ABSTRACT

Elongated cylinder heads are disclosed for mounting on engines and including cavities along the cylinder head for a number of injection units, with the cylinder head consisting of a single longitudinally extending fuel passage which interconnects these various cavities for the injection units in a manner such that all of the fuel for each of these injection units can be fed to and removed from the injection units therethrough.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

13 Claims, 3 Drawing Sheets

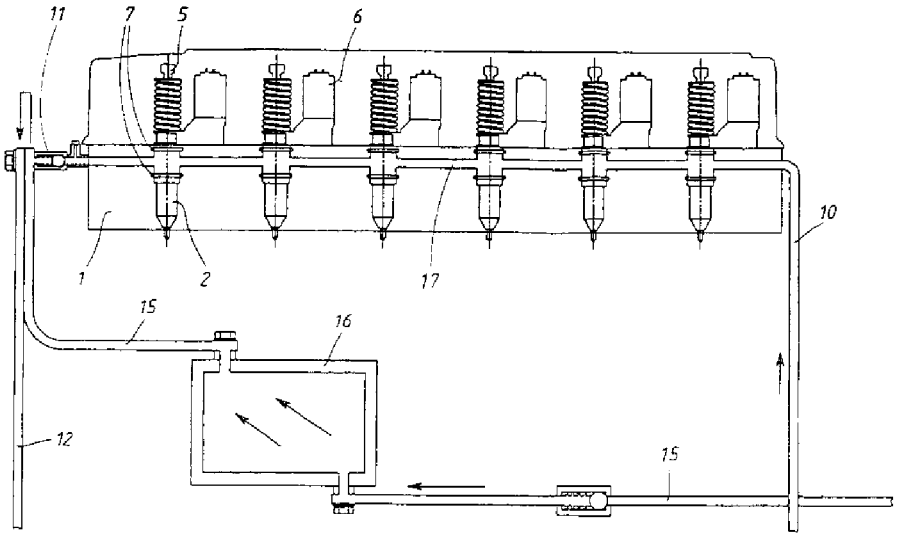

ELONGATED CYLINDER HEAD FOR MOUNTING ON FOR INSTANCE A DIESEL ENGINE HAVING CAVITIES FOR INJECTION UNITS AND SUPPLY MEANS FOR LIQUID FUEL

FIELD OF THE INVENTION

The present invention relates to a cylinder head for mounting on, for example, a diesel engine, which cylinder head is provided with cavities for injection units for injecting fuel into the engine and supply means for the liquid fuel. More particularly, the present invention relates to such cylinder heads which have an elongated shape and are intended to be mounted on the top side of an engine having several cylinders; e.g., six.

BACKGROUND OF THE INVENTION

Engines which are driven by liquid fuel, e.g. diesel oil, usually include a plurality of cylinders which are provided, at a regulated rate, with fuel by an injection nozzle, as well as sufficient air for combustion, and which must also include an outlet for the exhaust gases. These functions are usually combined in a cylinder head mounted as a cover on top of the cylinders. Since the cylinders are aligned in a row, the cylinder head will be elongated.

The cylinder head is generally molded with completed passages for air and exhaust gases, and possibly with cavities for the fuel injection units. These cavities may also be bored. However, it is always necessary to bore passages therethrough for supply of fuel to the cavities for the fuel injection units. These passages, of which there are two, normally have a diameter of approximately 9.5 millimeters, and they must run at a specific short distance from each other through the entire length of the cylinder head. The passages are usually bored from the ends of both short sides of the cylinder head. Since fuel from these passages is to be forced into the fuel injection units, it is necessary to seal the passages both from each other and from the surroundings. It has therefore been necessary to mount three surfaces which seal against O-rings on the injection unit, a first below the lowermost passage, the second between the passages, and the third above the uppermost passage.

One of the passages, preferably the lower one, is intended to feed fuel to the fuel injection units, whereas the second passage is intended for surplus fuel, and to lead same in the opposite direction to that of the fuel in the first passage, and to maintain a certain pressure in the system. The pressure level is controlled by a valve which is mounted with respect to the second passage.

The amount of fuel which is to be injected into the engine is portioned out through the injection units. However, the total amount of these portions is much lower than the total amount which is circulating, which is about four to eight times the total amount which is injected.

The space in the cylinder head is limited, since it must include both the inlet and the exhaust gas passages for the engine, as well as the cooling passages. The use of two fuel passages will therefore result in the dimensions of these and further passages having to be limited. This limited space does not allow for the desired freedom to design same.

As a result of the small dimension of the bores, working difficulties will arise, since it is difficult to maintain a straight and accurate direction in a bore having a small diameter and a considerable length, usually in the order of 1 m. As a consequence, a high incidence of rejects of the cylinder heads will arise, and a high level of processing will be required, which together results in high production costs.

With two passages, four outlets in every injection cavity will also be obtained, which outlets (or inlets) must be deburred so that impurities in the form of burrs will not be released into the fuel and cause damage to the impurity-sensitive injection units. This deburring process requires great attention, care and accuracy and has a negative influence on the production costs.

Various fuels which can be used in the engine are temperature-sensitive, and their lubricating capability is negatively influenced by too high a temperature, thus leading to operational disturbances. The cooling liquid and the greasing oil in and around the cylinder head heat the fuel which is transported through the bores in the cylinder head, and it is therefore of great importance that the heat transfer between the colder fuel and the surroundings will be as small as possible. With two passages each having a diameter of normally about 9.5 mm and a length of about 1 m, a projected heat transfer surface of about 60,000 $mm^2$ will be obtained.

SUMMARY OF THE INVENTION

In accordance with the present invention, this and other objects have now been realized by the invention of an elongated cylinder head for mounting on an engine, the elongated cylinder head including a first end and a second end, the first and second ends being transverse to the longitudinal direction of the elongated cylinder head, and the elongated cylinder head including a plurality of cavities for a corresponding plurality of injection units, and consisting of a single longitudinally extending fuel passage interconnecting the plurality of cavities whereby all of the fuel for each of the plurality of injection units is fed to and removed from the plurality of injection units thereby. In a preferred embodiment, the engine comprises a diesel engine, and the fuel comprises a diesel oil.

In accordance with one embodiment of the elongated cylinder head of the present invention, the cylinder head includes an air passage for feeding air to the elongated cylinder head. Preferably, a coolant passage is included for feeding coolant to the elongated cylinder head.

In accordance with another embodiment of the elongated cylinder head of the present invention, the longitudinally extending fuel passage exits into at least one of the first and second ends. In a preferred embodiment, the longitudinally extending fuel passage exits into both the first and second ends.

In accordance with another embodiment of the elongated cylinder head of the present invention, the elongated cylinder head includes at least one transverse passage connected to the longitudinally extending fuel passage for supplying or removing fuel therefrom. In a preferred embodiment, the at least one transverse passage is located proximate to one of the first and second ends of the elongated cylinder head. In another embodiment, one of the transverse passages is located proximate to each of the first and second ends of the elongated cylinder head.

In accordance with another embodiment of the elongated cylinder head of the present invention, the elongated cylinder head includes a pressure valve controlling the pressure of the fuel in the longitudinally extending fuel passage. In a preferred embodiment, the pressure valve is disposed in association with the one of the first and second ends which comprises the outlet for the longitudinally extending fuel path.

In accordance with another embodiment of the elongated cylinder head of the present invention, the longitudinally extending fuel passage has a diameter of between about 10 and 15 mm.

In accordance with another embodiment of the elongated cylinder head of the present invention, the longitudinally extending fuel passage includes an inlet and an outlet associated with each of the plurality of cavities, and wherein the elongated cylinder head includes only two surfaces adapted for sealing with an O-ring, the two surfaces including a first surface disposed above the inlet and the outlet for each of the plurality of cavities and a second surface disposed below the inlet and the outlet for each of the plurality of cavities.

According to the present invention, the above problems have been solved by means of an elongated cylinder head for mounting on, for example, a diesel engine having cavities for injection units and means for supplying liquid fuel, such as diesel oil, to these units, as well as air and cooling passages, if required. The cylinder head includes only one longitudinal fuel passage for feeding fuel to and removing of fuel from all of the injection units.

According to the present invention, the fuel passage can end in one or both of the shorter sides of the elongated cylinder head.

According to the present invention, one or more transverse passages for feeding or removing fuel to or from the longitudinal passage may be arranged at one or both of the ends of the longitudinal fuel passage.

According to the present invention, a valve for controlling the pressure of the fuel in the longitudinal fuel passage may either be arranged at the outlet end for the fuel, or outside the passage.

Further, according to the present invention, the longitudinal fuel passage can have a diameter of about 10 to 15 mm.

According to the present invention, only two surfaces may be provided in each cavity for sealing against O-rings mounted on the injection units, one above and one below the inlet and outlet openings for the longitudinal fuel passage.

BRIEF DESCRIPTION OF THE DRAWINGS

The present invention will be described in more detail in connection with the following detailed description, which refers to the attached figures, where.

DETAILED DESCRIPTION

Figure 1:
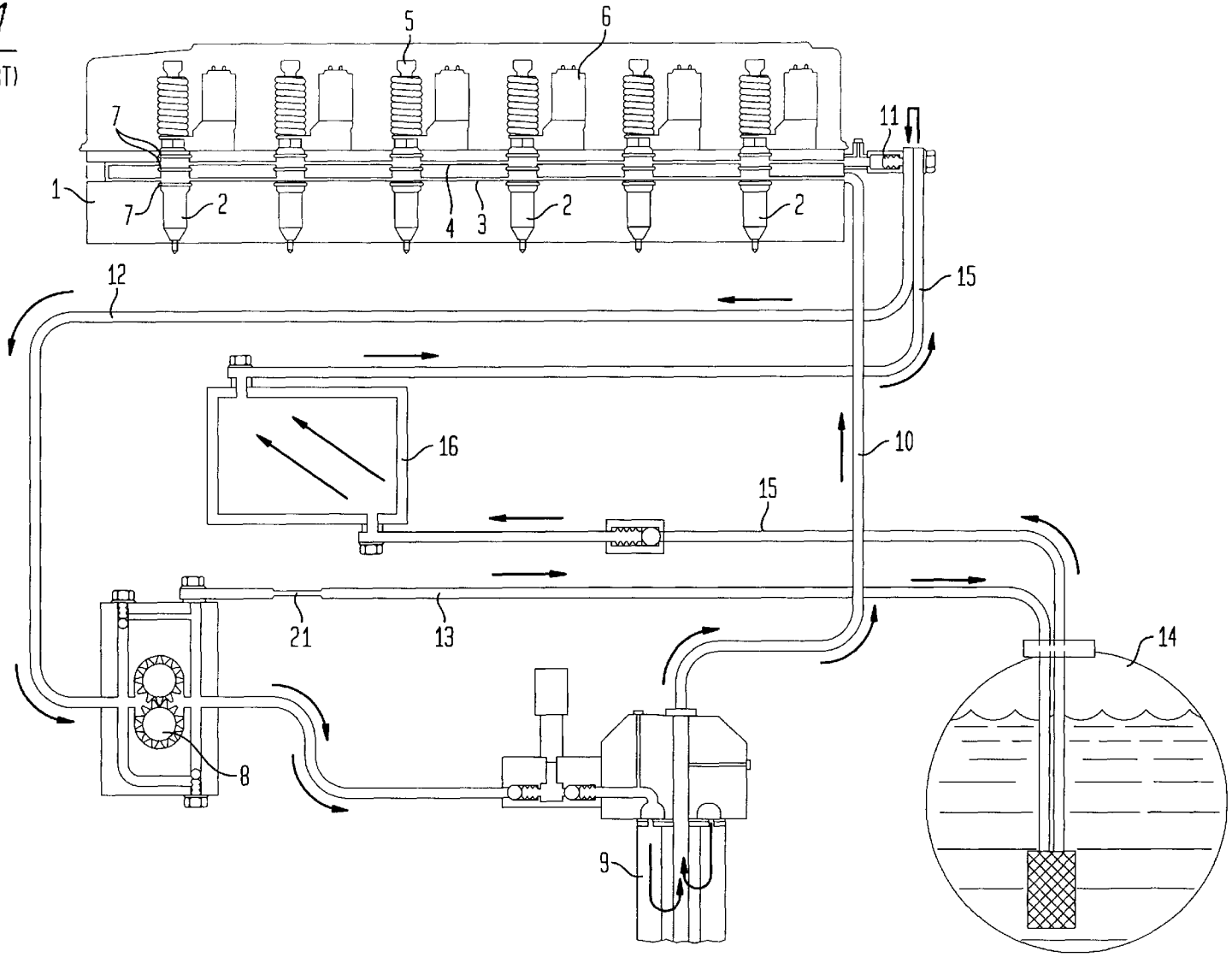
FIG. 1 (PRIOR ART)
FIG. 1 is a schematic representation of a flow sheet for fuel with a cylinder head according to the prior art.

Referring to the drawings, in which like reference numerals refer to like elements thereof, FIG. 1 schematically shows a cylinder head 1. Six cavities are arranged in a cylinder head in this case, which cavities each house an injection unit 2. These injection units 2 are supplied with fuel through two passages, 3 and 4. Passage 3 is the main supply passage, whereas passage 4 is intended for overflow fuel. By means of a cam shaft, a piston is pressed by a pin 5 against a spring force down into the injection unit 2, thus causing the injection of fuel. The amount of injected fuel and the time for this injection is controlled by means of valve arrangement 6, shown schematically in FIG. 1. When the piston is going upwards in the injection unit 2 fuel is sucked into this unit through a hole in the cylinder wall, or a suitable valve arrangement.

It is important that the flows of fuel in the cylinder head 1 be kept separated in a regulated manner, and therefore three O-rings 7 are arranged in grooves on the units 2. These O-rings 7 are located above the passage 4, below the passage 3, and between the two passages.

The pressure in the fuel system is created by means of a pump 8, which, through a filter 9 and a conduit 10, forces the fuel into the cylinder head 1. The pressure in the conduit 10 may be in the region of about 3 to 4 bar, and is regulated by a valve 11. The fuel which flows out against the pressure in the pressure controlling valve 11 arrives through the conduit 12 back into the pump 8. From the pump 8 a conduit 13 also leads to the fuel tank 14 from which fuel is sucked up through the conduit 15 and through a cooling arrangement 16 is united with the outgoing flow from the cylinder head 1 at pressure valve 11.

The amount of fuel which is pumped through conduit 12 is much larger than the amount of fuel used, and is in the order of about 2 to 12 lit/min. The amount of fuel which is sucked up from the fuel tank 14 through the conduit 15 will be in the order of about 0.2 to 1.5 l./min. The conduit 13 and the throttle 21 are an arrangement for removing possible gas in the system.

The longitudinal passages, 3 and 4, which may have a length on the order of about 1 m, are drilled form each end, usually by means of a gun boring drill. It is of the utmost importance that the two passages, 3 and 4, end in the cavities for the fuel injection units 2 at a correct location. This is, of course, difficult to accomplish since the passages are long as well as narrow, usually about 1 m long and about 9.5 mm wide. To ensure that the outlets into the cavities for the fuel injection units 2 are free of splinters, they must be deburred. There are two passages, 3 and 4, and three O-rings, 7, which renders the deburring the fine treatment to be rather costly.

According to the prior art shown in FIG. 1, the fuel supply is arranged at the rear of the cylinder head. If the engine is installed in a vehicle and, as is generally the case, the engine is not horizontal, but slopes slightly backwards, this renders it rather difficult for any gas in the system to be transported out of the engine since, according to the laws of nature, it will rise to the highest point in the engine. This can result in some difficulties in bleeding gas from the system in connection with repairs, etc. when the system is emptied of fuel. The rear side of the cylinder head 1 is to the right in FIG. 1.

Figure 2:
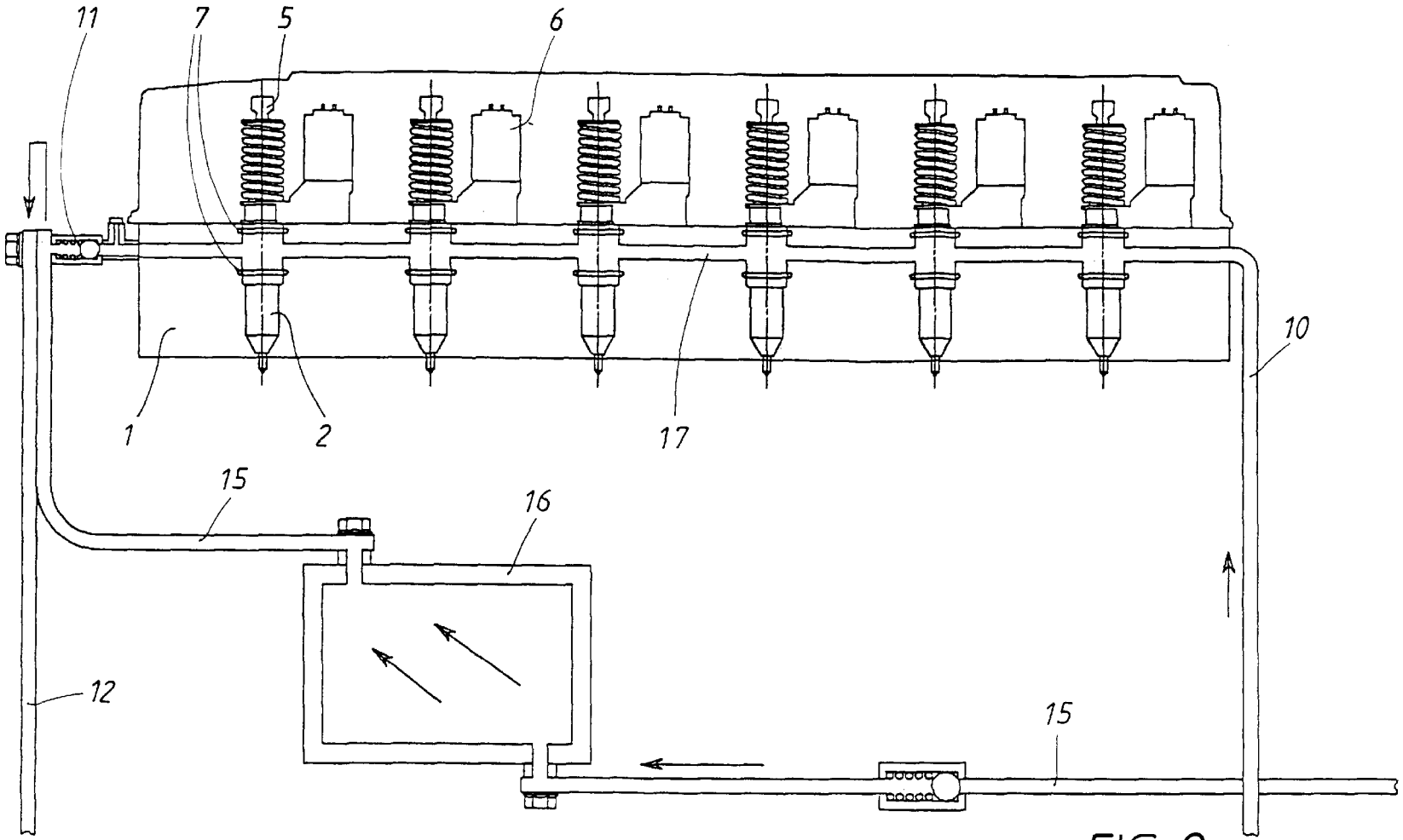
FIG. 2 is a top, schematic representation, in an enlarged scale, showing a portion of the flow shet according to FIG. 1, but with a cylinder head according to the present invention.

In FIG. 2 a fuel supply arrangement having a cylinder head 1 according to the present invention is shown in an enlarged scale. The reference numerals in this figure refer to the same elements as those in FIG. 1. The difference between the cylinder head in FIG. 2 and the one according to the prior art shown in FIG. 1 is that in FIG. 2 only one fuel supply passage 17 exists in the cylinder 1. In that manner, the construction of the cylinder head is simplified. Only one through flowing direction for fuel is obtained and only two O-rings 7, one on each side of the fuel passage 17, are required.

The supply of fuel to the cylinder head 1 occurs in this case at the rear side of the cylinder head 1 through the conduit 10, and excess fuel is taken out at the front side where the pressure fuel 11 is arranged. Since only one passage 17 is necessary according to the present invention, this passage may be provided with a larger diameter than is the case when two passages, 3 and 4, are drilled. The passage 17 usually has a diameter of 12.5 mm, but it may vary between about 10 and 15 mm. The reason for this is that only one passage is present, which of course requires less space than when two passages must be provided. When two passages, 3 and 4, are present according to the prior art, these passages require a certain distance between them, so that sufficient material thickness may be obtained. Therefore, other passages, such as air passages for the combustion air and exhaust passages, which also must have a certain wall thickness compared to the surroundings, must be made in such a way that they do not provide for optimal flow of the air and exhaust gases. In the arrangement according to the present invention, with only one passage 17, more space is now available for the combustion air and exhaust gas passages, as well as the cooling passages, which are usually contained in the cylinder head 1.

The pressure control valve may be mounted directly in the cylinder head 1. It is, of course, possible to arrange it at some other location in connection with a suitable pipe or hose. Since the pressure valve and the fuel can be taken out at the forward side of the cylinder head 1, which usually slopes somewhat backwards, the problem with air in the fuel passage is also solved, since this air can now simply be allowed to escape at the forward side, which is the highest point in the system.

Figure 3A:
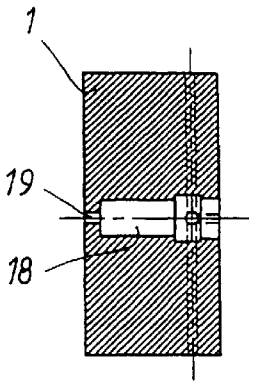
FIG. 3*a* is an end, elevational, sectional view of the cylinder head shown in FIG. 3, taken along line A—A thereof.
Figure 3B:
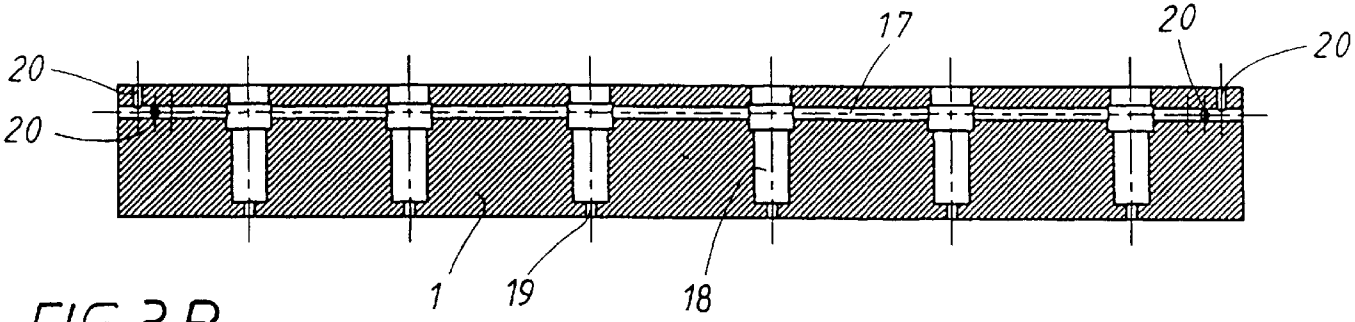
FIG. 3*b* is a side, elevational, sectional view of the cylinder head shown in FIG. 3, taken along lines B—B thereof.
Figure 3:
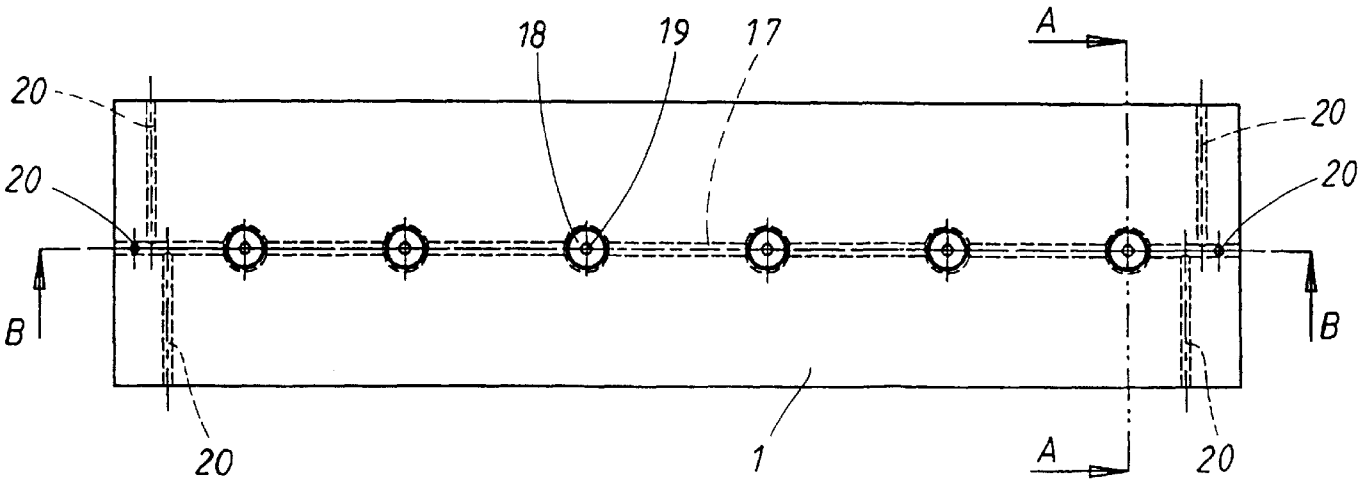
FIG. 3 is a top, elevational view of a cylinder head according to the present invention.

FIG. 3 shows the cylinder head 1 seen both from above and through sections B—B and A—A. Six cavities 18 are drilled or shaped in some other manner in the cylinder head 1, and these cavities end in an opening 19 through which the fuel injector protrudes into the engine cavity. At both ends of the cylinder head 1 transverse fuel passages 20 are arranged. These transverse fuel passages 20 are constructed to permit the supply of fuel to be arranged in different ways. One or two of the passages 20 may thus be used, and the others may be plugged, or all of the passages may be plugged, and the fuel supplied directly into the passage 17.

By means of the present invention several different advantages can now be obtained as compared to cylinder heads manufactured according to the prior art and having two narrow passages. It is relatively easy to drill the passage in the longitudinal direction of the cylinder head, but other manufacturing methods, such as molding or alternative working methods, may also be used. The cylinder head according to the present invention has also been made more compatible with other systems since the fuel supply may be arranged from the side or from above.

By correctly arranging a fuel passage having a size of from about 10 to 15 mm in the cylinder head a construction of the inlet and exhaust passages in the motor having minimized flow disturbances is made possible. This can be used to improve the efficiency of the motor.

In addition, the incidence of rejects arising from the fact that the direction of the drilling of the passages 3 and 4 cannot be correctly maintained, is eliminated. The time required to make one passage instead of two is shorter, and a lower total manufacturing cost can be realized. The number of deburring points in each injection cavity is also halved, which results in a shorter manufacturing time and consequently lowered manufacturing costs. Only one fuel passage and a motor arranged such that the fuel outlet is located in the forward part of the cylinder head, makes it possible to correctly transport possible gases. Handling in connection with repairs can also be substantially improved. The engine can also have a somewhat backwards sloping position without great difficulty. One passage having, for example, a diameter of about 12.5 mm, and a length of about 1 m, provides for a smaller projected surface, namely, about 39,000 $mm^2$, as compared with two passages of about 9.5 mm, which provides a projected surface of about 60,000 $mm^2$. Such a decreased surface provides for lower heat transfer, and thus less influence on the properties of the fuel. The risk of operational disturbances and damage to the components of the fuel system is therefore lowered.

What is claimed is:

1. An elongated cylinder head for mounting on an engine, said elongated cylinder head including a first end and a second end, said first and second ends being transverse to the longitudinal direction of said elongated cylinder head, and said elongated cylinder head including a plurality of cavities for a corresponding plurality of injection units, and consisting of a single longitudinally extending fuel passage interconnecting said plurality of cavities whereby all of the fuel for each of said plurality of injection units is fed to and removed from said plurality of injection units thereby.

2. The elongated cylinder head of claim 1 wherein said engine comprises a diesel engine, and said fuel comprises a diesel oil.

3. The elongated cylinder head of claim 1 including an air passage for feeding air to said elongated cylinder head.

4. The elongated cylinder head of claim 3 including a coolant passage for feeding coolant to said elongated cylinder head.

5. The elongated cylinder head of claim 1 wherein said longitudinally extending fuel passage exits into at least one of said first and second ends.

6. The elongated cylinder head of claim 5 wherein said longitudinally extending fuel passage exits into both said first and second ends.

7. The elongated cylinder head of claim 1 wherein said elongated cylinder head includes at least one transverse passage connected to said longitudinally extending fuel passage for supplying or removing fuel therefrom.

8. The elongated cylinder head of claim 7 wherein said at least one transverse passage is located proximate to one of said first and second ends of said elongated cylinder head.

9. The elongated cylinder head of claim 7 wherein one of said transverse passages is located proximate to each of said first and second ends of said elongated cylinder head.

10. The elongated cylinder head of claim 1 including a pressure valve controlling the pressure of said fuel in said longitudinally extending fuel passage.

11. The elongated cylinder head of claim 10 wherein said pressure valve is disposed in association with said one of said first and second ends which comprises the outlet for said longitudinally extending fuel path.

12. The elongated cylinder head of claim 1 wherein said longitudinally extending fuel passage has a diameter of between about 10 and 15 mm.

13. The elongated cylinder head of claim 1 wherein said longitudinally extending fuel passage includes an inlet and an outlet associated with each of said plurality of cavities, and wherein said elongated cylinder head includes only two surfaces adapted for sealing with an O-ring, said two surfaces including a first surface disposed above said inlet and said outlet for each of said plurality of cavities and a second surface disposed below said inlet and said outlet for each of said plurality of cavities.

* * * * *

UNITED STATES PATENT AND TRADEMARK OFFICE

CERTIFICATE OF CORRECTION

PATENT NO. : 6,234,135 B1
DATED : May 22, 2001
INVENTOR(S) : Jan Lindblom

It is certified that error appears in the above-identified patent and that said Letters Patent is hereby corrected as shown below:

Title page,
Item [57], ABSTRACT, delete "Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims."

Column 2,
Line 6, delete "forrn" and insert therefor -- form --.

Column 3,
Line 50, delete "shet" and insert therefor -- sheet --.
Line 56, "line" should read -- lines --.

Column 6,
Following line 13, insert -- Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. --

Signed and Sealed this

Twenty-sixth Day of July, 2005

JON W. DUDAS
*Director of the United States Patent and Trademark Office*